US005307748A

United States Patent [19]

Khinkis et al.

[11] Patent Number: 5,307,748

[45] Date of Patent: May 3, 1994

[54] CYCLONIC THERMAL TREATMENT AND STABILIZATION OF INDUSTRIAL WASTES

[75] Inventors: Mark J. Khinkis, Morton Grove; Hamid A. Abbasi, Darien, both of Ill.

[73] Assignee: Institute of Gas Technology, Chicago, Ill.

[21] Appl. No.: 31,244

[22] Filed: Mar. 12, 1993

[51] Int. Cl.[5] ..... F23G 5/00

[52] U.S. Cl. ..... 110/346; 110/256

[58] Field of Search ..... 110/345, 265, 256, 235

[56] References Cited

U.S. PATENT DOCUMENTS 3,202,405 8/1965 Stanley .
3,250,522 5/1966 Pack et al. .
3,284,915 11/1966 Berg .
3,373,981 3/1968 Taubmann et al. .
3,744,438 7/1973 Southwick .
3,926,582 12/1975 Powell, Jr. et al. .
4,052,265 10/1977 Kemp .
4,054,409 10/1977 Ando et al. .
4,060,376 11/1977 Peredi .
4,389,979 6/1983 Saxlund .
4,732,091 3/1988 Gould .
4,850,288 7/1989 Hoffert et al. .

*Primary Examiner*—Edward G. Favors
*Attorney, Agent, or Firm*—Speckman, Pauley & Fejer

[57] ABSTRACT

A process and apparatus for thermal treatment and stabilization of waste materials in which waste material is introduced into an uppermost first combustion zone of a vertically oriented combustion chamber and a fuel and an oxidant are tangentially injected into the first combustion zone, oxidizing at least a portion of any organic material in the waste materials and melting at least a portion of any inorganic material in the waste materials. A second portion of fuel and oxidant is injected into a second combustion zone disposed immediately below and in communication with the first combustion zone, melting any remaining inorganic material in the waste material after which the melted waste material is removed from the bottom area of the combustion chamber for disposal.

24 Claims, 2 Drawing Sheets

CYCLONIC THERMAL TREATMENT AND STABILIZATION OF INDUSTRIAL WASTES

BACKGROUND OF THE INVENTION

1. Field of the Invention

This invention relates to a process and apparatus for thermal treatment of waste materials using cyclonic combustion which produces low emissions and stable residues. The process and apparatus of this invention provide a very high level of destruction of organic materials in the waste materials while producing a stable, mostly inorganic, vitrified residue having low surface area-to-volume ratios and very low leachability characteristics.

2. Description of the Prior Art

Disposal of waste materials, in particular industrial waste materials, is an ever increasing environmental problem. It is no longer acceptable merely to dispose of raw waste materials in landfills or dumps because many of such waste materials have been shown to create environmental problems, such as by leaching into the surrounding soil, requiring massive clean-up efforts. Numerous processes and apparatuses for disposing of such waste materials are known. The most desirable of these processes and apparatuses produce low emissions into the atmosphere and stabilized residues which can be safely disposed of or, perhaps, subsequently reused for some other purpose.

U.S. Pat. No. 3,926,582, teaches a method and apparatus for pyrolytic treatment of solid waste materials in which solid waste material is charged into the upper region of a pyrolysis chamber and an oxygen-rich gas is charged under pressure into the chamber at a plurality of vertically spaced points along the length thereof to produce combustion of the organic components of the solid waste material and generate heat, producing a plurality of downwardly increasing temperature zones so as to effect incomplete combustion of the organic components and form a combustible gas in the upper zones while melting and oxidizing the inorganic components of the solid waste material into an organic-free molten refractory material in the lower most zone. One disadvantage of this process is the requirement that oxygen-rich gas be employed, thereby adding significantly to the cost of treatment of the solid waste materials. Multi-zone combustion is also taught by U.S. Pat. No. 4,389,979 in which at least a portion of the combustion air required for combustion of fuel is introduced tangentially into the combustion chamber of a stoker-fired boiler. U.S. Pat. No. 4,060,376 teaches a method for combustion of non-gaseous fuels in which the fuel is decomposed in the presence of deficient amounts of primary combustion air to produce a hot combustible gas which is subsequently combusted in secondary and tertiary combustion zones of a furnace and exhausted therefrom. To maintain combustion temperatures below 1400° C. and, thus, control the formation of nitrogen oxides and sulfur trioxides, tertiary combustion air is supplied in more than one stage.

Pyrolysis of combustible solid materials such as waste is taught by U.S. Pat. No. 4,732,091 in which the combustible solid waste material is introduced into the upper section of a pyrolysis chamber and moves downwardly at a controlled rate through multiple stage zones in the pyrolysis chamber, countercurrent to hot gases which are the products of partial oxidation of carbon char occurring at the bottom of a pyrolysis chamber, which hot gases pass upwardly into the pyrolysis chamber.

Cyclonic combustion is taught by U.S. Pat. No. 4,850,288 in which particulate solids are fed tangentially into a primary combustion chamber at its inlet end and flow at high tangential velocity in a helical path through a burner. Oxygen containing combustion gas is supplied tangentially at high velocity through multiple ports spaced along the burner length to maintain and/or increase the high tangential velocity and produce centrifugal forces on the particulate solids, thereby providing for prolonged combustion and high burner volumetric heat release rates. A swirling burner for hot blast stoves having a vertical combustion chamber and an annular blast member located beneath the combustion chamber and provided with a central cylindrical space and a plurality of alternately superposed fuel gas passages and air passages is taught by U.S. Pat. No. 4,054,409.

U.S. Pat. No. 3,744,438 teaches a shaft-type furnace for incineration of refuse materials having a plurality of heating zones in which an essentially non-combustible base mass is charged to the lower zone thereof and heated to molten or semi-molten temperatures, the molten mass providing a high temperature environment in the upper second zone disposed above the lower zone. The refuse material fluid which can be air or a similar fluid which provides support for and/or promotes incineration of the refuse materials are charged into the upper second zone. Non-combustible refuse contained therein drops into the molten mass from which it may easily removed.

U.S. Pat. No. 4,052,265 teaches a process for pyrolytic treatment of waste materials in which the materials are conveyed on a conveyer through a controlled atmosphere treatment chamber without combustion supporting air or other oxidizing agents and caused to progressively thermally breakdown into their more basic constituents which flow out of the material treatment chamber in a continuous liquid and gaseous vapor stream.

Finally, the use of vertical shaft furnaces for treatment of solids in which the solids are generally introduced into the top portion of the shaft furnace or kiln and fall to the bottom through various combustion zones generated within the furnace are taguth by U.S. Pat. Nos. 3,284,915, 3,373,91, 3,250,522, and 3,202,405.

SUMMARY OF THE INVENTION

It is an object of this invention to provide a process and apparatus for thermal treatment and stabilization of waste materials which produces low pollutant emissions and stable residues.

It is another object of this invention to provide a process and apparatus for treatment of waste materials which provides a very high level of destruction of organic materials in said waste materials.

It is yet another object of this invention to provide a process for the treatment of industrial waste which produces a stable, mostly inorganic, vitrified residue having low surface area to volume ratios and very low leachability characteristics.

These and other objects of this invention are achieved by a process for thermal treatment and stabilization of waste materials which is carried out in a vertically oriented combustion chamber. Waste material to be treated is introduced into an uppermost first combustion zone of the vertically oriented combustion chamber. A fuel and an oxidant are tangentially injected into the first combustion zone, resulting in oxidation of at least a portion of any organic material contained in the waste material and melting of at least a portion of an inorganic material in said waste material. A second portion of fuel and oxidant is injected into a second combustion zone in the vertically oriented combustion chamber disposed immediately below and in communication with the first combustion zone. Any remaining portion of organic material in the waste material is oxidized and any remaining inorganic material in the waste material is melted. Finally, the melted waste material is removed from a bottom area of the combustion chamber for disposal.

A significant feature of the process of this invention is the tangential injection of fuel and oxidant into the first combustion zone to create a swirling flow pattern with internal recirculation to stabilize the combustion, increase the reaction between the oxidant and the organic material in the waste material and create a uniform temperature within the first combustion zone allowing operation at close to ash fusion temperature to provide high combustible oxidation and low inorganics melting. The waste material is injected into the uppermost first combustion zone axially in the center, axially off center, and/or tangentially. In accordance with one embodiment of this invention the waste material is injected tangentially together with the fuel and oxidant into the first combustion zone of the combustion chamber.

In a particularly preferred embodiment of the process of this invention, the oxidant and fuel are premixed prior to tangential injection into the first combustion zone.

In accordance with a preferred embodiment of the process of this invention, the second portion of fuel and oxidant are tangentially injected into the second combustion zone.

In accordance with another embodiment of the process of this invention, a third portion of fuel and oxidant is injected into a third combustion zone within the vertically oriented combustion chamber disposed immediately below and in communication with the second combustion zone. Combustibles remaining in the combustion products from the first and second combustion zones are burned out in the third combustion zone and exhausted from the combustion chamber.

In accordance with one embodiment of this invention, at least one of said first and second combustion zones in the vertically oriented combustion chamber is oxidant deficient, that is, contains less than a stoichiometric requirement for complete combustion of the fuel and oxidation of the waste material, to decompose nitrogen compounds therein for reduction of $NO_x$ or where a "reducing" atmosphere provides better melting. The last zone in the combustion chamber, which, in accordance with one embodiment of the process of this invention is the second combustion zone and in accordance with another embodiment of this invention is a third combustion zone, always contains excess oxidant to ensure complete burn-out of combustibles remaining in combustion products from the upstream combustion zones.

An apparatus for thermal treatment and stabilization of waste material in accordance with one embodiment of this invention comprises a vertically oriented combustor having at least one combustor wall which forms a plurality of axially aligned combustion zones, primary means for tangentially injecting a first portion of a fuel and an oxidant into the uppermost first combustion zone of the combustor, means for introducing waste material into the first combustion zone, secondary means for injecting a second portion of fuel and oxidant into a second combustion zone disposed immediately below and in communication with the first combustion zone, means for removing treated waste material from the combustor in communication with the second combustion zone, and means for exhausting products of combustion from the combustor in communication with and disposed downstream of the second combustion zone.

In accordance with a preferred embodiment of the apparatus of this invention, the combustor has a cylindrical shape, thereby enhancing the swirling flow pattern generated by tangential injection of the fuel and oxidant into the first combustion zone of the combustor.

In accordance with another embodiment of this invention, means for restricting fluid flow between at least two adjacent combustion zones within the combustor are disposed between the adjacent combustor zones. In particular, said means for restricting fluid flow comprises a orifice wall disposed between adjacent combustion zones and secured to the combustor wall, the orifice wall having an opening coaxially aligned with the combustion zones. Such flow restricted orifice installed at the exit of the first combustion zone enhances the swirling flow and internal recirculation therein for enhanced burnout and combustion stability. In accordance with another embodiment of this invention, a second orifice may be installed at the exit of the second combustion zone to enhance swirl therein. In accordance with yet another embodiment of this invention, a third orifice may be installed at the exit of the third combustion zone to further enhance swirl, internal recirculation and composition, and temperature uniformity within the third combustion zone.

In accordance with one embodiment of this invention, each of said combustion zones within the combustor is refractory lined. In accordance with another embodiment of this invention, said combustion zones are water cooled and refractory lined. Cooling the refractory lined combustion zones helps to maintain temperatures within the combustion zones below the level at which $NO_x$ is formed, and thus reduces $NO_x$ emissions from the combustor.

To enhance the efficiency of the combustor, the combustion products exhausted from the combustor flow through a heat exchanger in which heat is transferred from the combustion products to at least one of the fuel and the oxidant for preheating said fuel or oxidant. In accordance with another embodiment of this invention, the combustion products are introduced into a reformer in which the fuel is reformed. In accordance with yet another embodiment of this invention, the heat in the combustion products is used to preheat the waste material.

BRIEF DESCRIPTION OF THE DRAWINGS

These and other features of this invention will be better understood when viewed in light of the following detailed description taken in conjunction with the drawings wherein.

DESCRIPTION OF PREFERRED EMBODIMENTS

Figure 1:
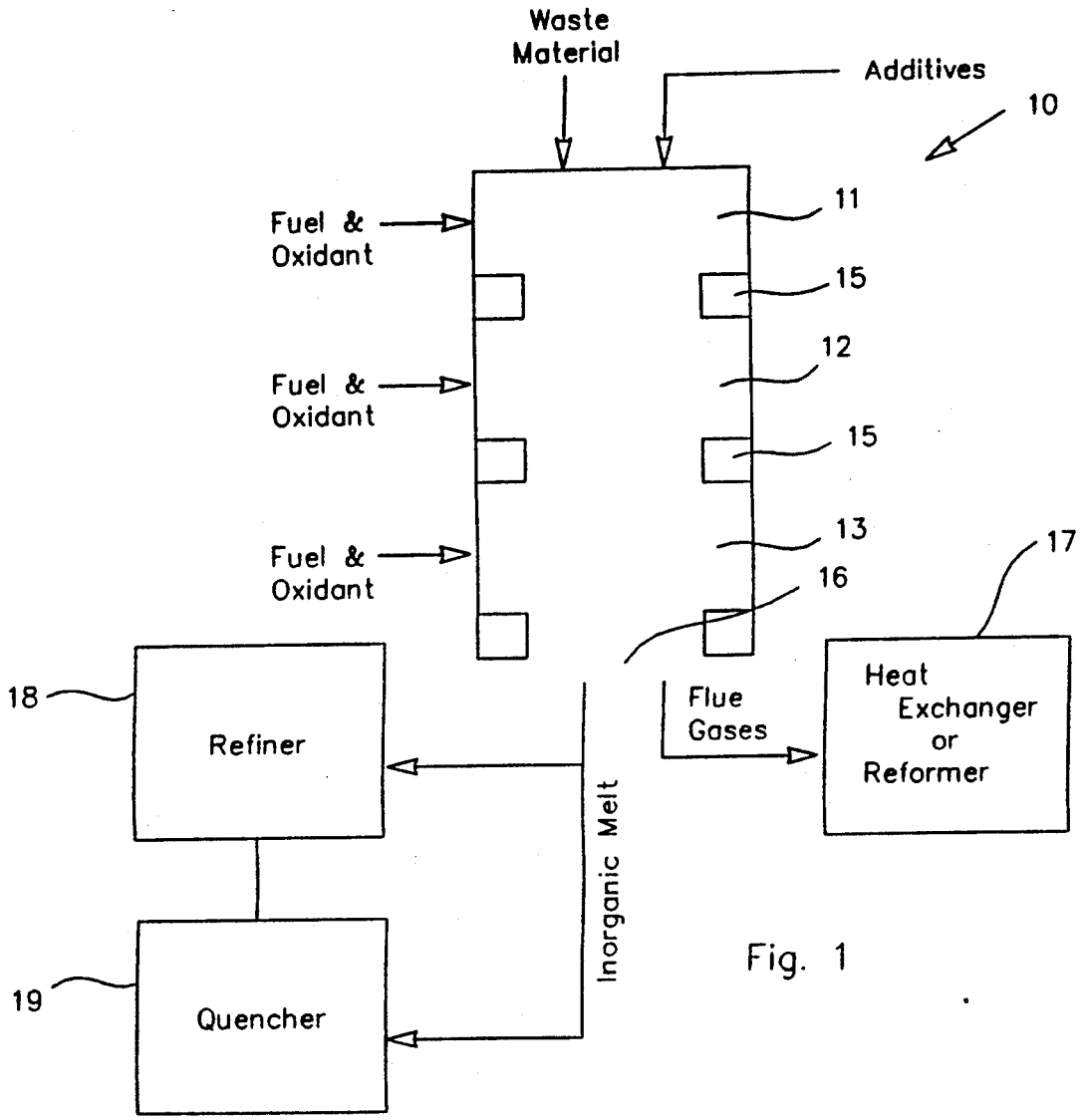
FIG. 1 is schematic diagram of the process in accordance with one embodiment of this invention.

In accordance with one embodiment of the process of this invention as shown in FIG. 1, waste material is introduced into first combustion zone 11 of a vertically oriented combustion chamber 10, which first combustion zone is the uppermost combustion zone in vertically oriented combustion chamber 10. Although almost any waste material comprising inorganic components is suitable for treatment in accordance with this process, the waste material preferably is industrial waste comprising organic and inorganic components.

Figure 2:
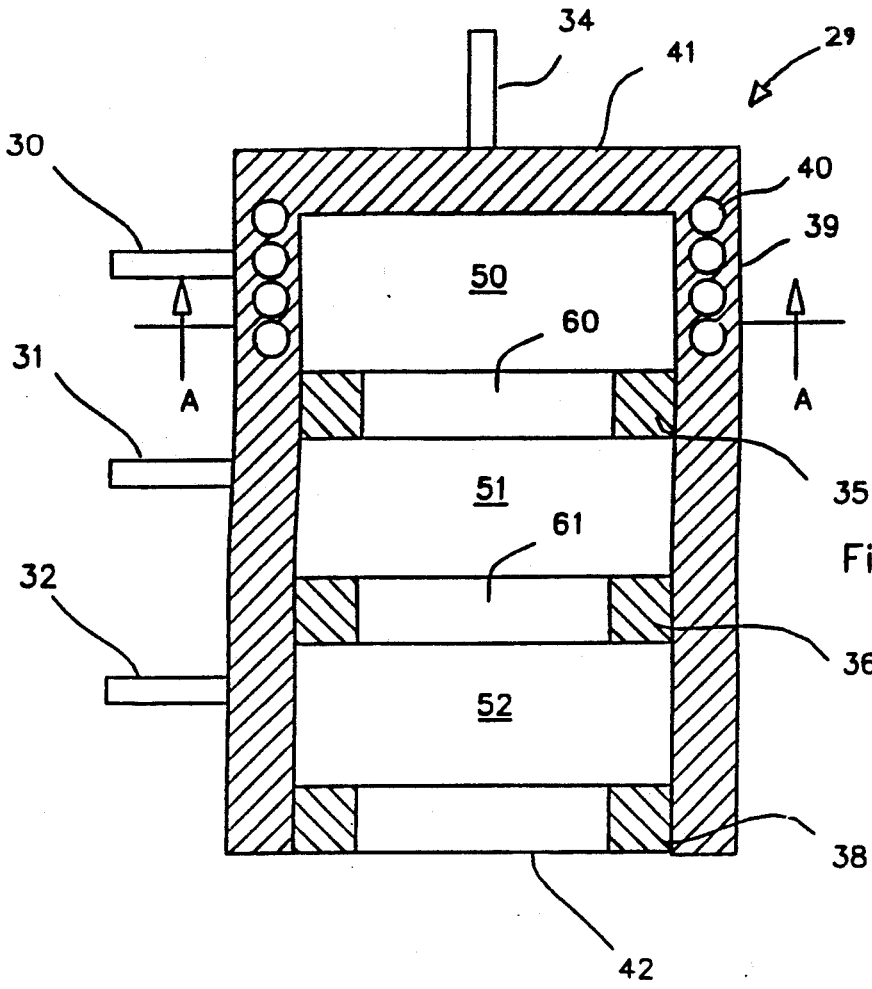
FIG. 2 is a cross-sectional side view of a combustor for use in the process shown in FIG. 1.

Fuel and oxidant are tangentially injected into first combustion zone 11, oxidizing at least a portion of any organic material in the waste material to produce at least CO, $CO_2$, and $H_2O$. To minimize the melting of inorganic material in the waste material, spatial temperatures within first combustion zone 11 are maintained close to or below the ash fusion temperature of the waste material. As a result, entrapment of organic materials in the melt layer that may be formed on the refractory walls and, thus, the potential for formation of an undesirable frothy melt is substantially reduced. The fuel and oxidant are injected tangentially near combustor lid 41 as shown in FIG. 2 to create a swirling flow pattern with internal recirculation which helps stabilize combustion within combustion chamber 10, increases the reaction between the oxidant and the organics in the waste material, and creates a uniform temperature in first combustion zone 11, thus allowing operation at close to ash fusion temperatures to provide high combustible oxidation and low inorganics melting. The small amount of melt droplets formed in first combustion zone 11 are thrown onto the combustor walls where they flow downwards by gravity in a thin layer.

In a preferred embodiment of this invention, combustion chamber 10 is cylindrical to enhance the effects of the swirling flow pattern created by tangential injection of the fuel and oxidant.

In accordance with one embodiment of the process of this invention, the waste material is also tangentially injected into first combustion zone 11. However, the waste material may also be injected axially along the longitudinal axis of combustion chamber 10 or axially off-center, that is, parallel to the longitudinal axis of combustion chamber 10. In accordance with yet another embodiment of this invention, the waste material is tangentially injected together with the fuel and oxidant into first combustion zone 11.

In accordance with a particularly preferred embodiment of this invention, the fuel injected into first combustion zone 11 is natural gas. In addition, to limit the formation of $NO_x$ within combustion chamber 10, the atmosphere within first combustion zone 11 is a reducing atmosphere resulting in decomposition of $NO_x$ precursors.

However, in accordance with another embodiment of the process of this invention in which it is desired to maximize burnout of combustibles within combustion chamber 10, the atmosphere in first combustion zone 11 may be an oxidizing atmosphere.

A second portion of fuel and oxidant are injected into second combustion zone 12 disposed immediately below and in communication with first combustion zone 11 of combustion chamber 10, oxidizing at least a portion of any remaining organic material flowing into second combustion zone 12 from first combustion zone 11 by gravity and melting at least a portion of any inorganic material in the waste material. The melted waste material is removed from bottom area 16 of combustion chamber 10.

In accordance with a preferred embodiment of this invention, the second portion of fuel and oxidant injected into second combustion zone 12 is injected tangentially therein. However, the fuel and oxidant injected into second combustion zone 12 may be injected radially or at any angle between tangential and radial injection.

In accordance with a preferred embodiment of this invention, the fuel and oxidant are premixed prior to injection into combustion chamber 10.

In accordance with a preferred embodiment of this invention, to enhance the swirling flow pattern and internal recirculation for enhanced combustion stability and burnout of combustibles in combustion chamber 10, flow restriction means 15 are installed between first combustion zone 11 and second combustion zone 12. As shown in FIG. 2, first orifice 35 is secured to combustor wall 39 between first combustion zone 11 and second combustion zone 12. First orifice 35 forms an opening having a diameter between about 0.3 to about 0.8 of the diameter of combustion chamber 10.

In accordance with another embodiment of this invention, flow restriction means 15 in the form of second orifice 36 is disposed at the downstream end of second combustion zone 12. Each of said flow restriction means 15 disposed between said adjacent combustion zones enhances the swirl, internal recirculation, composition and temperature uniformity within the combustion zone immediately upstream of flow restriction means 15.

In accordance with another embodiment of this invention, oxidant is injected into third combustion zone 13 disposed immediately below and in communication with second combustion zone 12 to ensure complete burnout of combustibles remaining in combustion chamber 10 prior to being exhausted therefrom. As previously stated, first combustion zone 11 may comprise a reducing atmosphere or an oxidizing atmosphere. Similarly, second combustion zone 12 may also comprise a reducing atmosphere or an oxidizing atmosphere. However, third combustion zone 13, or in accordance with an embodiment of this invention in which combustion chamber 10 comprises only first combustion zone 11 and second combustion zone 12, second combustion zone 12 always comprises an oxidizing atmosphere to ensure complete burnout of combustibles in the products of combustion produced in combustion chamber 10 prior to being exhausted therefrom.

To achieve specific melt characteristics of the waste material for disposal, additives may be added to the waste material prior to introduction into combustion chamber 10 or may be introduced directly into combustion chamber 10 to react with the inorganic materials in the waste material to produce the desired melt and/or exhaust gas characteristics. For example, a flux, such as silica or limestone, may be added to decrease to ash melting temperature, and/or an additive such as limestone may be added to convert acid gases such as $SO_x$, HCl, and HF into less harmful compounds such as $CaCl_2$, $CaF_2$, and $CaSO_4$ and/or to bind high vapor pressure metals which may be present in the waste material.

To provide greater efficiency of the process of this invention, gases exhausted from combustion chamber 10 are introduced into conditioning and/or heat recovery equipment prior to discharge to the atmosphere. In accordance with one embodiment of this invention, the heat in the exhaust gases is partially recovered by preheating the oxidant and/or the fuel prior to injection into combustion chamber 10. In accordance with another embodiment of this invention, the heat in the exhaust gases is partially recovered by reforming the fuel. In accordance with yet another embodiment of this invention, heat in the exhaust gases is partially recovered by preheating the waste material.

The inorganic melt produced in combustion chamber 10 is drawn off from the bottom area of combustion chamber 10 and introduced directly into quencher 19 to form a glassy mass of low leachability or into refiner 18 where it is further refined chemically or thermally prior to quenching in quencher 19.

It will be apparent to those skilled in the art that different fuels and oxidants may be introduced into combustion chamber 10 for treatment of the waste material in accordance with the process of this invention. Thus, a different fuel may be introduced into each of the combustion zones comprising combustion chamber 10. Similarly, the oxidant comprises an oxygen-containing gaseous fluid, but it is preferably one of air, oxygen and oxygen enriched air.

FIG. 2 shows a vertically oriented combustor 29 for treatment and stabilization of waste materials suitable for use in the process shown in FIG. 1 having at least one combustor wall 39 forming a plurality of axially aligned combustion zones. Combustor 29 comprises primary means for tangentially injecting a first portion of a fuel and an oxidant into an uppermost first combustion zone, said tangential injection means comprising first fuel and oxidant supply 30 secured to combustor wall 39 and in communication with uppermost first combustion zone 50. Waste material is introduced into first combustion zone 50 through means for introducing waste materials into first combustion zone 50 in the form of waste supply inlet 34 secured to combustor wall 39 and in communication with first combustion 50. Secondary means for injecting a second portion of fuel and oxidant into second combustion zone 51 disposed immediately below and in communication with first combustion zone 50 in the form of second fuel and oxidant supply 31 is secured to combustor wall 39 and in communication with second combustion zone 51. Treated waste materials and products of combustion are removed from combustor 29 through exit end 42.

Figure 3:
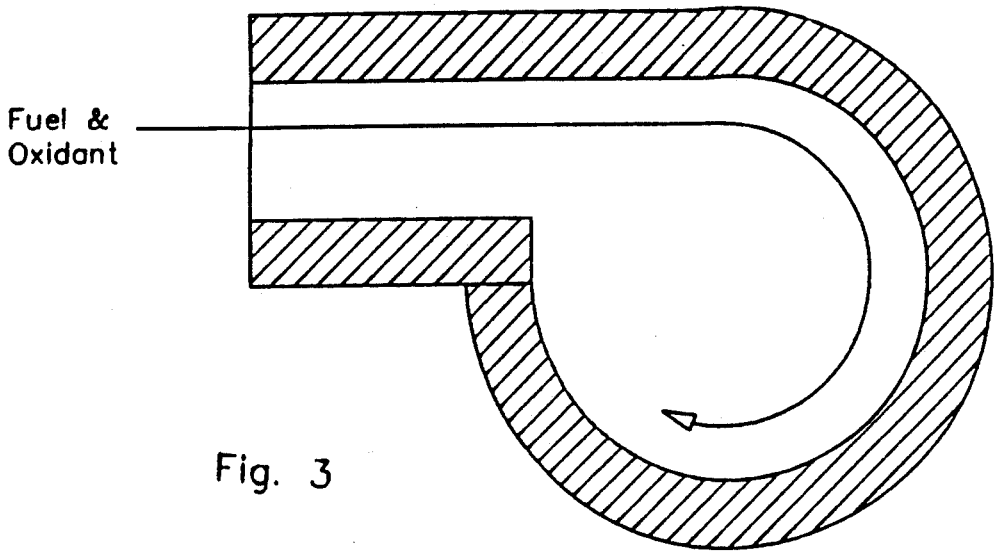
FIG. 3 is a cross-sectional view along the line A—A of the combustor shown in FIG. 2.

In a preferred embodiment of this invention, combustor 29 is cylindrical as shown in FIG. 3. FIG. 3 also shows first fuel and oxidant supply 30 secured to combustor wall 39 in such a manner as to provide tangential injection of fuel and oxidant into first combustion zone 50.

To provide restriction of fluid flow between first combustion zone 50 and second combustion zone 51, orifice wall 35 is secured to combustor wall 39 disposed between first combustion zone 50 and second combustion zone 51, orifice wall 35 forming first orifice opening 60. Similarly, exit orifice wall 38 is disposed at outlet end 42 of combustor 29. In accordance with one embodiment of this invention as shown in FIG. 2, combustor 29 comprises third combustion zone 53. In accordance with this embodiment, second orifice wall 36 is disposed between second combustion zone 51 and third combustion zone 53 and forms second orifice opening 61. It will be apparent to those skilled in the art that combustor 29 need not have an orifice disposed between each combustion zone thereof. And, thus, several embodiments of combustor 29 in accordance with this invention are possible. In a preferred embodiment of this invention, each orifice opening has a diameter between about 0.3 and about 0.8 of the diameter of combustor 29.

Combustor wall 39 is normally refractory lined. However, in accordance with one embodiment of this invention, combustor wall 39 comprises cooling tubes 40 for fluid cooling of combustion zone within combustor 29.

Finally, it will be apparent to those skilled in the art that the internal diameters of each of first combustion zone 50, second combustion zone 51, and, if applicable, third combustion zone 53 may differ from one another depending upon swirl patterns, internal recirculation, and other conditions required in said respective combustion zones for treatment and stabilization of the waste material introduced therein.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for thermal treatment and stabilization of waste material comprising:

introducing said waste material into an uppermost first combustion zone of a vertically oriented combustion chamber;

tangentially injecting a fuel and an oxidant into said first combustion zone, oxidizing at least a portion of an organic material in said waste material and melting at least a portion of an inorganic material in said waste material;

injecting a second portion of said fuel and said oxidant into a second combustion zone disposed immediately below and in communication with said first combustion zone, oxidizing any remaining portion of said organic material and melting any remaining inorganic material in said waste material; and removing melted waste material from a bottom area of said combustion chamber.

2. A process in accordance with claim 1, wherein a spatial temperature in said first combustion zone is below an ash fusion temperature.

3. A process in accordance with claim 1, wherein said fuel is natural gas.

4. A process in accordance with claim 1, wherein said oxidant comprises an oxygen-containing gaseous fluid.

5. A process in accordance with claim 4, wherein said oxidant is one of air, oxygen and oxygen-enriched air.

6. A process in accordance with claim 1, wherein said second portion of said fuel and said oxidant are tangentially injected into said second combustion zone.

7. A process in accordance with claim 1, wherein a third portion of said fuel and said oxidant is injected into a third combustion zone disposed immediately below and in communication with said second combustion zone, burning out combustibles remaining in combustion products from said first and second combustion zones.

8. A process in accordance with claim 1, wherein said waste material is tangentially injected into said first combustion zone.

9. A process in accordance with claim 1, wherein the heat in combustion products exhausted from said combustion chamber is recovered.

10. A process in accordance with claim 9, wherein said recovered heat is used to at least one of preheat said oxidant, preheat said waste material, preheat said fuel and reform said fuel.

11. A process in accordance with claim 1, wherein at least one additive is at least one of mixed with said waste material and introduced directly into said first combustion zone of said combustion chamber.

12. A process in accordance with claim 11, wherein said additive is one of a flux for decreasing an ash melting temperature and a compound for one of converting acid gases in said combustion chamber into less harmful compounds and chemically binding high vapor pressure metals in said combustion chamber.

13. A process in accordance with claim 1, wherein said first combustion zone is oxidant deficient.

14. A process in accordance with claim 7, wherein at least one of said first combustion zone and said second combustion zone is oxidant deficient.

15. In a vertically oriented combustor for treatment and stabilization of waste material having at least one combustor wall forming a plurality of axially aligned combustion zones, the improvement comprising:

primary means for tangentially injecting a first portion of a fuel and an oxidant into an uppermost first combustion zone of said combustor;

means for introducing said waste material into said first combustion zone;

secondary means for injecting a second portion of said fuel and said oxidant into a second combustion zone disposed immediately below and in communication with said first combustion zone;

means for removing treated waste material from said combustor in communication with said second combustion zone; and means for exhausting products of combustion from said combustor in communication with and disposed downstream of said second combustion zone.

16. In a vertically oriented combustor in accordance with claim 15, wherein said combustor has a cylindrical shape.

17. In a vertically oriented combustor in accordance with claim 15, wherein means for restricting fluid flow between at least two adjacent said combustion zones are disposed between said adjacent combustion zones.

18. In a vertically oriented combustor in accordance with claim 17, wherein said means for restricting fluid flow comprises an orifice wall disposed between said adjacent combustion zones and secured to said combustor wall, said orifice wall having an opening coaxially aligned with said combustion zones.

19. In a vertically oriented combustor in accordance with claim 18, wherein the diameter of said opening is between about 0.3 to about 0.8 of the diameter of said combustion zone immediately upstream of said orifice wall.

20. In a vertically oriented combustor in accordance with claim 15, wherein said combustion zones are one of refractory-lined and water-cooled, refractory-lined.

21. In a vertically oriented combustor in accordance with claim 15, wherein said means for exhausting products of combustion from said combustor comprises mean for preheating at least one of said fuel, said oxidant and said waste material.

22. In a vertically oriented combustor in accordance with claim 15, wherein said means for exhausting products of combustion from said combustor comprises means for reforming said fuel.

23. In a vertically oriented combustor in accordance with claim 15, wherein said combustor wall forms a third combustion zone disposed immediately below and in communication with said second combustion zone.

24. In a vertically oriented combustor in accordance with claim 23, wherein tertiary means for injecting a third portion of said fuel and said oxidant are in communication with said third combustion zone.

* * * * *